US011680376B2

(12) United States Patent
Murdoch et al.

(10) Patent No.: US 11,680,376 B2
(45) Date of Patent: Jun. 20, 2023

(54) EDGE PROTECTION SYSTEM HAVING SUPPORT FOOT

(71) Applicant: Illinois Tool Works Inc., Glenview, IL (US)

(72) Inventors: Thomas James Murdoch, Warooka (AU); Greg Stephen Mason, Rochedale South (AU)

(73) Assignee: Illinois Tool Works Inc., Glenview, IL (US)

( * ) Notice: Subject to any disclaimer, the term of this patent is extended or adjusted under 35 U.S.C. 154(b) by 278 days.

(21) Appl. No.: 16/753,222

(22) PCT Filed: Sep. 18, 2018

(86) PCT No.: PCT/US2018/051515
§ 371 (c)(1),
(2) Date: Apr. 2, 2020

(87) PCT Pub. No.: WO2019/074630
PCT Pub. Date: Apr. 18, 2019

(65) Prior Publication Data

US 2020/0325638 A1 Oct. 15, 2020

(30) Foreign Application Priority Data

Oct. 13, 2017 (AU) ..... 2017904151
Sep. 3, 2018 (AU) ..... 2018226391

(51) Int. Cl.
*E01C 11/14* (2006.01)
*E04B 5/32* (2006.01)
(Continued)

(52) U.S. Cl.
CPC ..... *E01C 11/14* (2013.01); *E04B 5/32* (2013.01); *E04B 1/48* (2013.01);
(Continued)

(58) Field of Classification Search
CPC ..... E01C 11/106; E01C 11/126; E01C 11/14; E04B 5/32; E04B 2005/173;
(Continued)

(56) References Cited

U.S. PATENT DOCUMENTS 2,094,853 A 10/1937 Shaw
2,181,005 A 11/1939 Westcott
(Continued)

FOREIGN PATENT DOCUMENTS

CA 2712305 A1 7/2009
DE 102007020816 B3 10/2008
(Continued)

OTHER PUBLICATIONS

International Search Report and Written Opinion from International Patent Application No. PCT/US2018/051515, dated Dec. 19, 2018 (12 pages).
(Continued)

*Primary Examiner* — Jessie T Fonseca
(74) *Attorney, Agent, or Firm* — Neal, Gerber & Eisenberg LLP

(57) ABSTRACT

An edge protection system for use with concrete flooring, including a first part for coupling to an edge portion of a first concrete flooring panel and a second part for coupling to an opposed edge portion of a second, neighbouring, concrete flooring panel, and a support foot for supporting the system relative to a ground surface, wherein the first part has a pair of vertically opposed longitudinal rails, and the support foot has an engagement formation which has an unlocked orientation for inserting the formation between the opposed rails to abut against the first part and a rotated, locked orientation wherein the formation is locked by the rails against lateral withdrawal from the first part.

13 Claims, 14 Drawing Sheets

(51) Int. Cl.
*E04B 1/48* (2006.01)
*E04F 15/14* (2006.01)

(52) U.S. Cl.
CPC ... *E04B 2005/322* (2013.01); *E04B 2005/324* (2013.01); *E04F 15/14* (2013.01)

(58) Field of Classification Search
CPC ..... E04B 2005/322; E04B 2005/324; E04B 1/48; E04F 15/02194; E04F 15/142; E04F 15/14; E04G 21/185; E04G 13/00
See application file for complete search history.

(56) References Cited

U.S. PATENT DOCUMENTS 2,316,233 A 4/1943 Fischer
2,325,472 A * 7/1943 Brickman ..... E01C 11/14 404/60
2,349,983 A 5/1944 Alexander
2,508,443 A * 5/1950 Carter ..... E01C 11/106 404/60
2,654,297 A 10/1953 Nettleton
3,559,541 A 2/1971 Watstein
4,522,531 A * 6/1985 Thomsen ..... E01C 11/14 404/49
4,648,739 A * 3/1987 Thomsen ..... E01C 11/14 404/49
4,733,513 A 3/1988 Schrader et al.
4,942,912 A 7/1990 Gakhar et al.
5,005,331 A 4/1991 Shaw et al.
5,205,942 A 4/1993 Fitzgerald
5,216,862 A 6/1993 Shaw et al.
5,261,635 A 11/1993 Flathau
5,458,433 A 10/1995 Stastny
5,487,249 A 1/1996 Shaw et al.
5,730,544 A 3/1998 Dils et al.
5,830,378 A 11/1998 Butler
6,019,546 A 2/2000 Ruiz
6,021,994 A 2/2000 Shartzer
6,145,262 A 11/2000 Schrader et al.
6,354,760 B1 3/2002 Boxall et al.
6,550,213 B1 4/2003 Butler
6,629,681 B1 10/2003 Miller et al.
6,775,952 B2 8/2004 Boxall et al.
6,874,288 B1 4/2005 Washa et al.
6,926,463 B2 8/2005 Shaw et al.
7,228,666 B2 6/2007 Michiels
7,338,230 B2 3/2008 Shaw et al.
7,481,031 B2 1/2009 Boxall et al.
7,547,158 B1 * 6/2009 Mucci ..... E01C 11/08 404/47
7,604,432 B2 10/2009 Shaw et al.
7,637,689 B2 12/2009 Boxall et al.
7,716,890 B2 5/2010 Boxall et al.
7,736,088 B2 6/2010 Boxall et al.
8,142,104 B2 3/2012 Connolly
8,302,359 B2 11/2012 Boxall et al.
8,303,210 B2 11/2012 Parkes et al.
8,356,955 B2 1/2013 Nadler
8,381,470 B2 2/2013 Boxall et al.
8,516,761 B2 8/2013 Laiho et al.
8,539,726 B2 9/2013 Laiho et al.
8,573,884 B2 11/2013 Nadler
8,627,626 B2 1/2014 Boxall et al.
9,260,867 B2 2/2016 Arnold
9,574,309 B2 2/2017 Mcdonald
9,637,874 B2 5/2017 Ganey et al.
9,765,485 B2 9/2017 Keen
10,094,075 B2 10/2018 Keen
10,260,230 B2 * 4/2019 Rogers ..... E04C 5/08
10,323,359 B2 6/2019 Meuwissen et al.
10,711,410 B2 7/2020 Meuwissen et al.
2003/0146365 A1 8/2003 Miller et al.
2006/0275078 A1 12/2006 Shaw et al.
2007/0269266 A1 11/2007 Kelly et al.
2010/0054858 A1 3/2010 Mayo et al.
2010/0086351 A1 4/2010 Mercer et al.
2015/0016870 A1 * 1/2015 Arnold ..... E04B 1/483 403/266
2017/0009446 A1 1/2017 Eve
2018/0135297 A1 5/2018 Parkes et al.

FOREIGN PATENT DOCUMENTS

FR 3043105 A1 5/2017
GB 2285641 A 7/1995
GB 2421049 6/2006
GB 2467877 8/2010
GB 2500626 10/2013
GB 2511729 9/2014
GB 2530344 3/2016
WO 2004065694 A1 8/2004
WO 2005111332 A2 11/2005
WO WO 2005/103412 11/2005
WO 2009153604 A1 12/2009
WO 2010004294 A2 1/2010
WO 2006123176 A9 11/2010
WO WO 2013/076500 5/2013
WO 2013128151 A1 9/2013
WO WO 2014/060752 4/2014
WO WO 2014/096980 6/2014
WO WO 2014/111712 7/2014
WO 2019074632 A1 4/2019

OTHER PUBLICATIONS

Diamond Dowel® System Tapered Plate Dowels for Formed Construction Joints brochure , PNA Construction Technologies, available Jan. 2010 (2 pages).
Diamond™ Dowel Load Transfer System Industrial Slab on Ground brochure, Danley™ Systems, available Sep. 2016 (8 pages).
Load Transfer Systems Dowel Cradles Industrial Slab on Ground brochure, ITW Construction Systems and Danley Systems, available prior to Nov. 16, 2016 (12 pages).

* cited by examiner

EDGE PROTECTION SYSTEM HAVING SUPPORT FOOT

CROSS-REFERENCE TO RELATED APPLICATIONS

This application is related to the following commonly owned co-pending patent applications: U.S. application Ser. No. 16/753,089, entitled "EDGE PROTECTION SYSTEM HAVING CLIP RETAINMENT,"; U.S. application Ser. No. 16/753,114, entitled "EDGE PROTECTION SYSTEM WITH INTERSECTION MODULE," US; U.S. application Ser. No. 16/753,189, entitled "EDGE PROTECTION SYSTEM HAVING BRIDGING PINS,"; U.S. application Ser. No. 16/753,274, entitled "EDGE PROTECTION SYSTEM HAVING RETAINING CLIP,"; and U.S. application Ser. No. 16/753,384, entitled "EDGE PROTECTION SYSTEM HAVING DOWEL PLATE,".

PRIORITY

This application is a national stage application of PCT/US2018/051515, filed on Sep. 18, 2018, which claims priority to and the benefit of Australian Patent Application No. 2017904151, filed Oct. 13, 2017, and Australian Patent Application No. 2018226391, filed Sep. 3, 2018, the entire contents of each of which are incorporated herein by reference.

FIELD

The present disclosure relates generally to an edge protection system for protecting the edges of concrete flooring panels and, more specifically but not exclusively to an edge protection system providing improved modularity and efficient installation.

BACKGROUND

It is known to provide edge protection systems for protecting the edges of concrete flooring panels. In particular, a problem exists in that concrete flooring panels, for example of a warehouse, can be subject to damage at an interface between neighbouring (adjacent) concrete panels, particularly when heavy objects such as a loaded forklift are driven over the panel interface. The panels are prone to being chipped or otherwise damaged by forklifts and the like as the weight is transferred from one panel to the neighbouring panel. So as to minimize damage to the panel edges, it has been proposed to provide an edge protection system which may support one panel relative to the next and may shield the edges of the panels. Although such existing edge protection systems can be effective in reducing damage to concrete flooring panels, the applicant has identified that existing systems are typically time consuming to install and limit flexibility of effective installation.

Examples of the present disclosure seek to provide an improved edge protection system for use with concrete flooring which may avoid or at least ameliorate disadvantages of existing edge protection systems.

BRIEF SUMMARY

In accordance with the present disclosure, there is provided an edge protection system for use with concrete flooring, including a first part for coupling to an edge portion of a first concrete flooring panel and a second part for coupling to an opposed edge portion of a second, neighbouring, concrete flooring panel, and a support foot for supporting the system relative to a ground surface, wherein the first part has a pair of vertically opposed longitudinal rails, and the support foot has an engagement formation which has an unlocked orientation for inserting the formation between the opposed rails to abut against the first part and a rotated, locked orientation wherein the formation is locked by the rails against lateral withdrawal from the first part.

In various preferred embodiments, the edge protection system includes a second support foot for supporting the system relative to the ground surface, wherein the second part has a pair of vertically opposed longitudinal rails, and the second support foot has an engagement formation which has an unlocked orientation for inserting the formation between the opposed rails to abut against the second part and a rotated, locked orientation wherein the formation is locked by the rails against lateral withdrawal from the second part.

In various preferred embodiments, the formation is unlocked from the opposed rails by rotation of the formation about a lateral axis of the system from the locked orientation to the unlocked orientation.

BRIEF DESCRIPTION OF THE DRAWINGS

The disclosure is described, by way of non-limiting example only, with reference to the accompanying drawings, in which.

DETAILED DESCRIPTION

Figure 1:
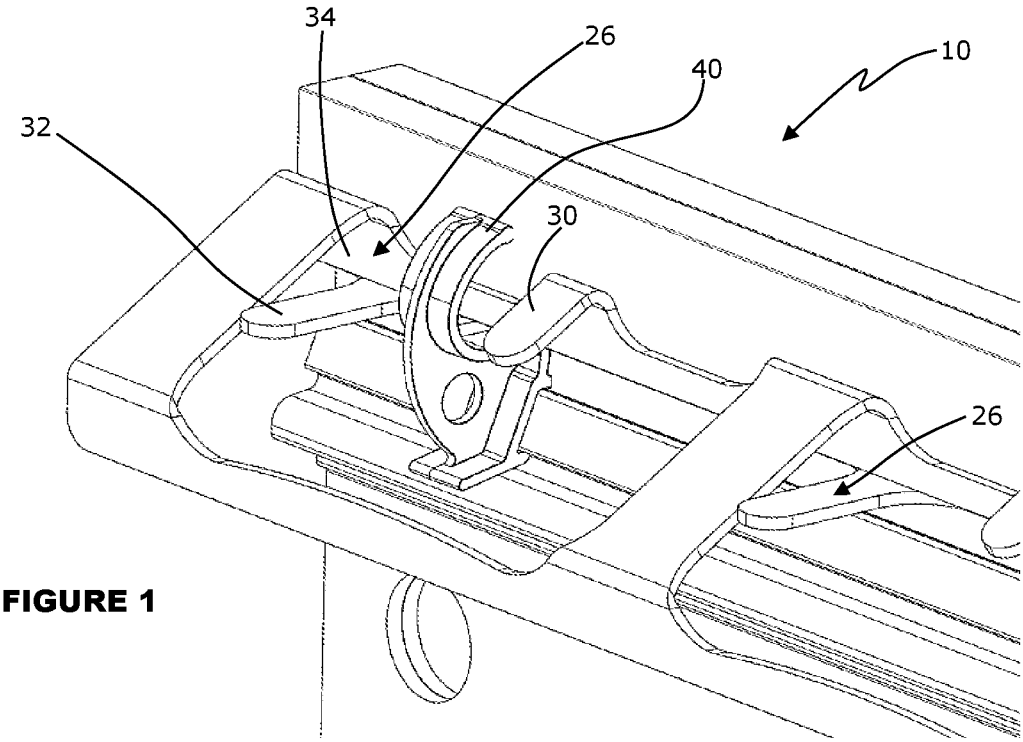
FIG. 1 shows detail of one end of a module of an edge protection system in accordance with an example of the present disclosure.

While the systems, devices, and processes described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting processes, such as mounted, connected, etc., are not intended to be limited to direct mounting processes but should be interpreted broadly to include indirect and operably mounted, connected, and like mounting processes. This specification is intended to be taken as a whole and interpreted in accordance with the principles of the present disclosure and as understood by one of ordinary skill in the art.

With reference to FIGS. 1 to 17 of the drawings, there is shown an edge protection system 10 in accordance with an example of the present disclosure. The edge protection system 10 as shown in the drawings may provide advantages in that there is improved modularity as well as more efficient installation when compared with existing edge protection systems 10 for use with concrete flooring panels. Several aspects are embodied in the edge protection system 10, and these aspects will be discussed below, in turn.

Bridging Pin

As shown in FIGS. 1 to 6 of the drawings, there is provided an edge protection system 10 for use with concrete flooring, specifically to avoid or at least reduce damage of concrete flooring panels, for example in a concrete floor of a warehouse or the like. The edge protection system 10 includes a first part 12 for coupling to an edge portion of a first concrete flooring panel and a second part 14 for coupling to an opposed edge portion of a second, neighbouring concrete flooring panel. The protection system 10 is provided in modular lengths 16, and adjacent modular lengths are coupled by one or more bridging pins 18. Advantageously, the edge protection system 10 benefits from having a continuous steel structure by virtue of the bridging pins 18, which in one example are made of steel, as well as by virtue of an anchorage length of each modular length which may also be formed of steel. The bridging pins assist in holding together several modular lengths of the edge protection system in a relatively straight and rigid formation such that the edge protection system 10 is properly aligned for installation when compared with existing edge protection systems which typically have excessive sloppiness and play.

Figure 2:
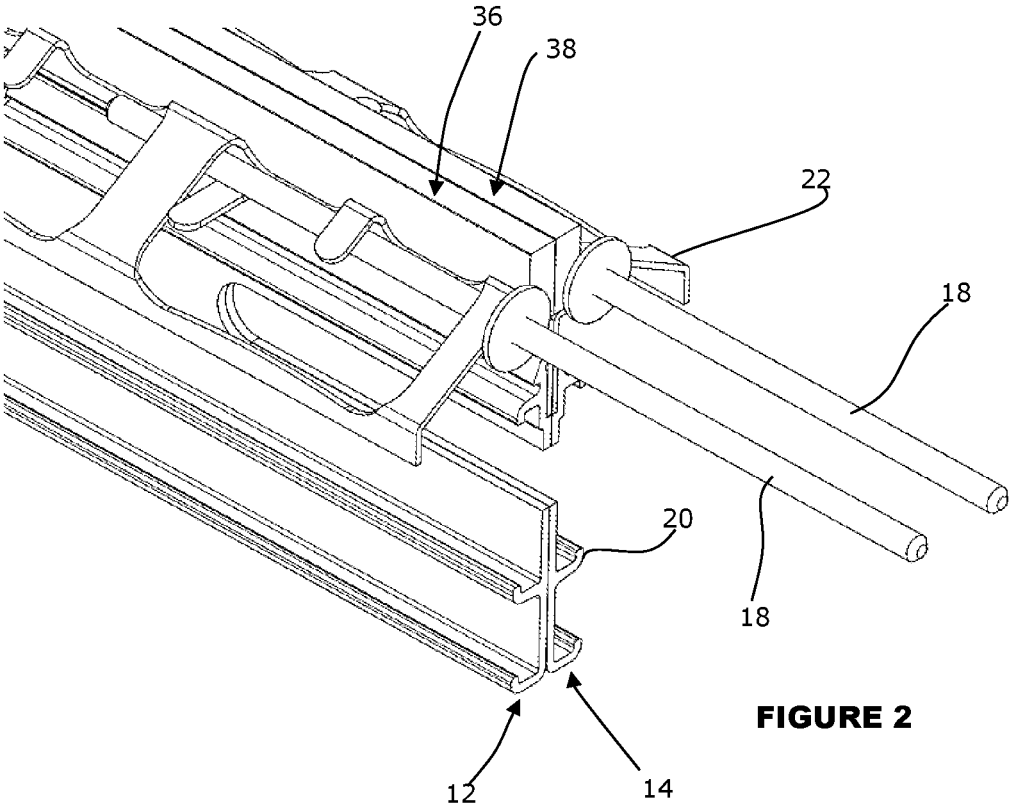
FIG. 2 shows detail of an opposite end of the module.
Figure 3:
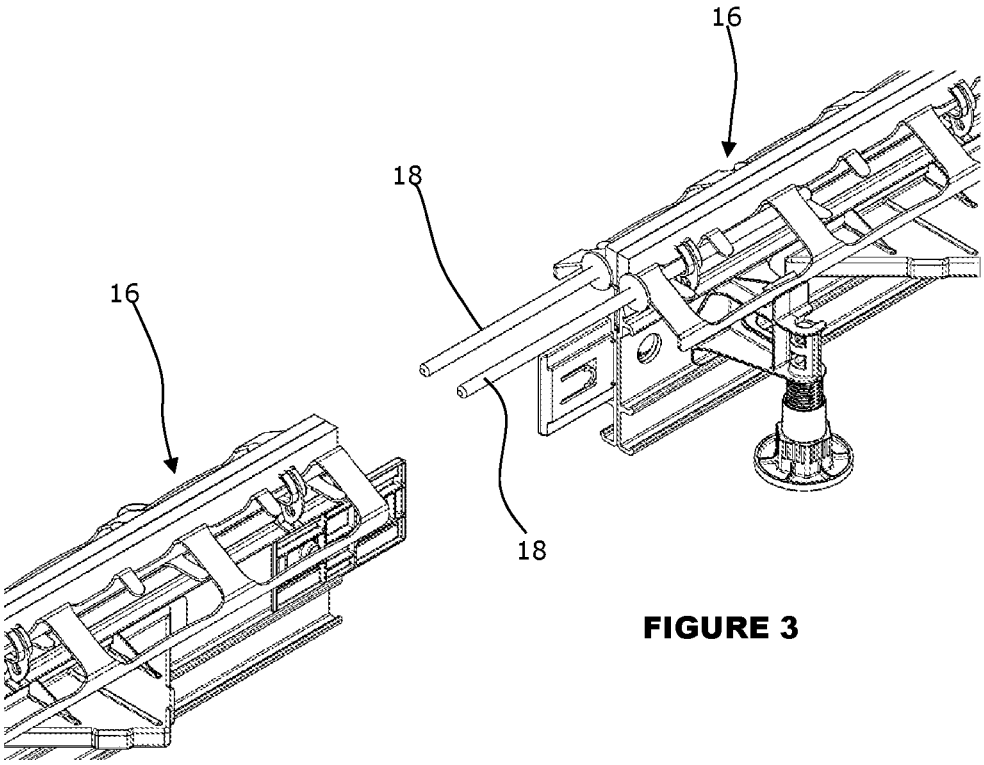
FIG. 3 shows ends of adjacent modules prior to coupling.
Figure 4:
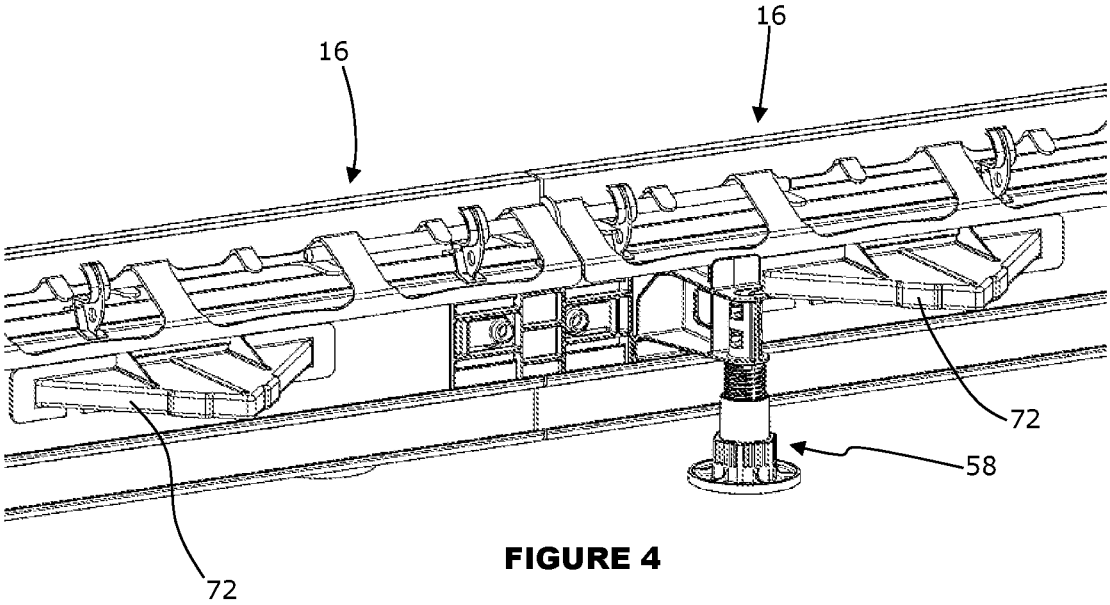
FIG. 4 shows ends of the adjacent modules after coupling.

As shown in FIG. 2, each modular length 16 includes a formwork length 20 and an anchorage length 22. As can be seen, the formwork length 20 is shaped so as so to provide formwork for the edge of the concrete panel, and the anchorage length 22 has an anchorage 24 for anchoring within the concrete of the concrete panel.

In practice, depending on the dimensions of the concrete panel to be formed, the edge protection system may include a plurality of formwork lengths 20 and a plurality of anchorage lengths 22. The formwork lengths 20 may each be formed of plastic material, in particular PVC material. Alternatively, the formwork lengths may be formed of metal material, in addition or as an alternative to the plastic material. The formwork lengths may each be formed as an extrusion.

As can be seen particularly in FIGS. 2 to 6 of the drawings, the bridging pins extend in parallel to a longitudinal axis of the edge protection system 10, being fed through apertures 26 formed by the formwork lengths 20 as well as by retaining clips 28 which are used to hold together the first part 12 and the second part 14. The parallel bridging pins 18 shown in FIG. 2 extend on opposite sides of the edge protection system 10, one bridging pin 18 being for the first part 12 and the other bridging pin 18 being for the second part 14. The bridging pins 18 shown in the example depicted in the drawings are formed of steel, however alternative examples may include bridging pins formed of plastic.

Each anchorage length 22 is formed of sheet material folded to form a series of spaced triangular apertures 26 along the anchorage length 22, and the bridging pins 18 are aligned to extend through the triangular apertures 26 so as to hold together the modules of the edge protection system 10 in alignment. The formwork lengths 20 may also include securing tabs 30 which are able to be bent downwardly over the bridging pins 18 so as to hold the bridging pins securely in place. With reference to FIG. 1, the triangular apertures 26 are seen to be formed between a downwardly angled and longitudinally continuous anchorage portion 24 which forms the hypotenuse of the triangle a horizontal tap 32 which forms the base of the triangle and a vertical face 34 of the anchorage length 22 which forms an upright of the triangle.

Figure 5:
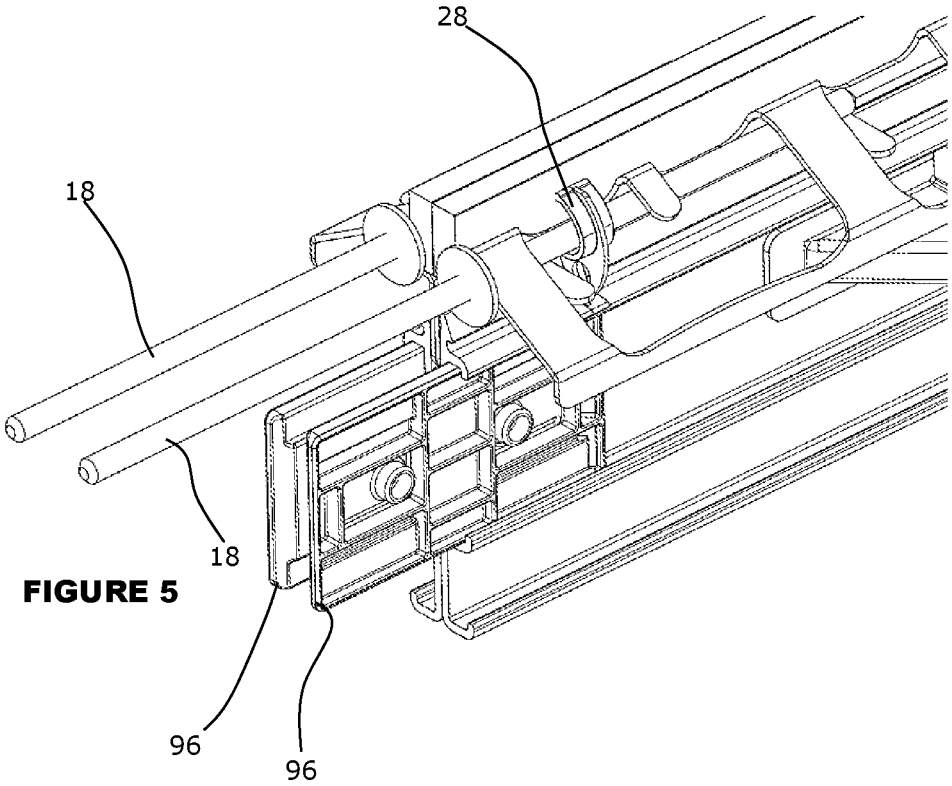
FIG. 5 shows an end of the module being fitted with a pair of joiner plates.
Figure 6:
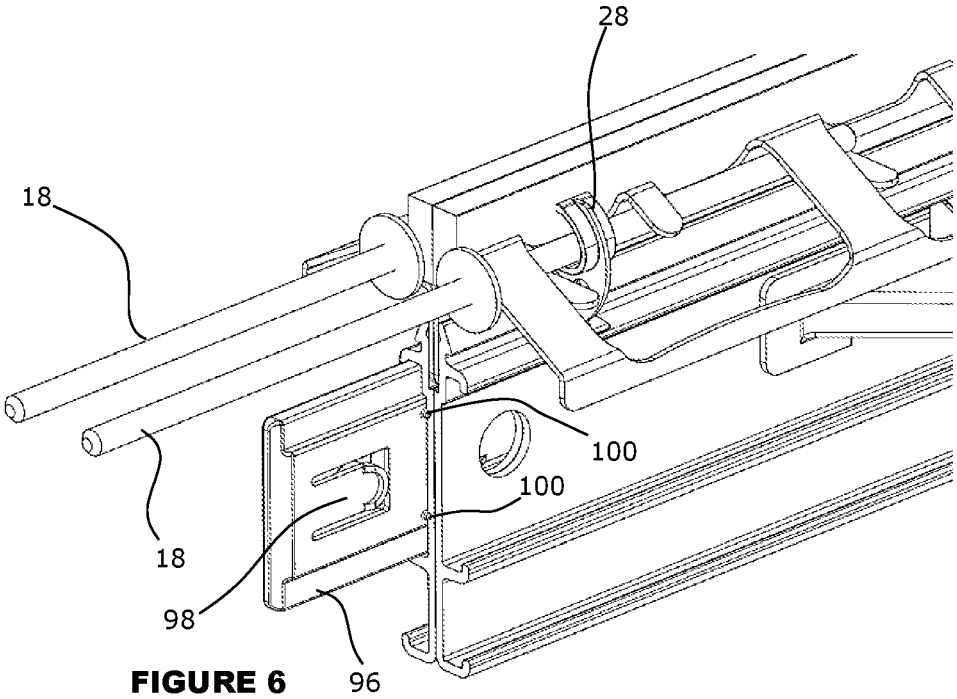
FIG. 6 shows an end of the module being fitted with a single joiner plate.
Figure 7:
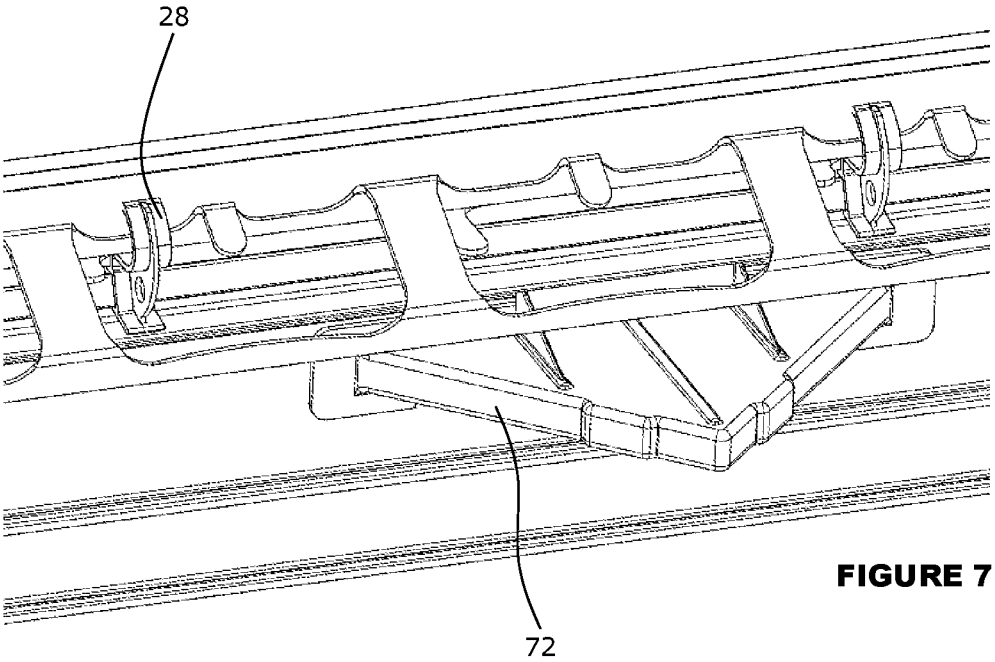
FIG. 7 is a side perspective view of the module showing detail of dowel sheath.
Figure 8:
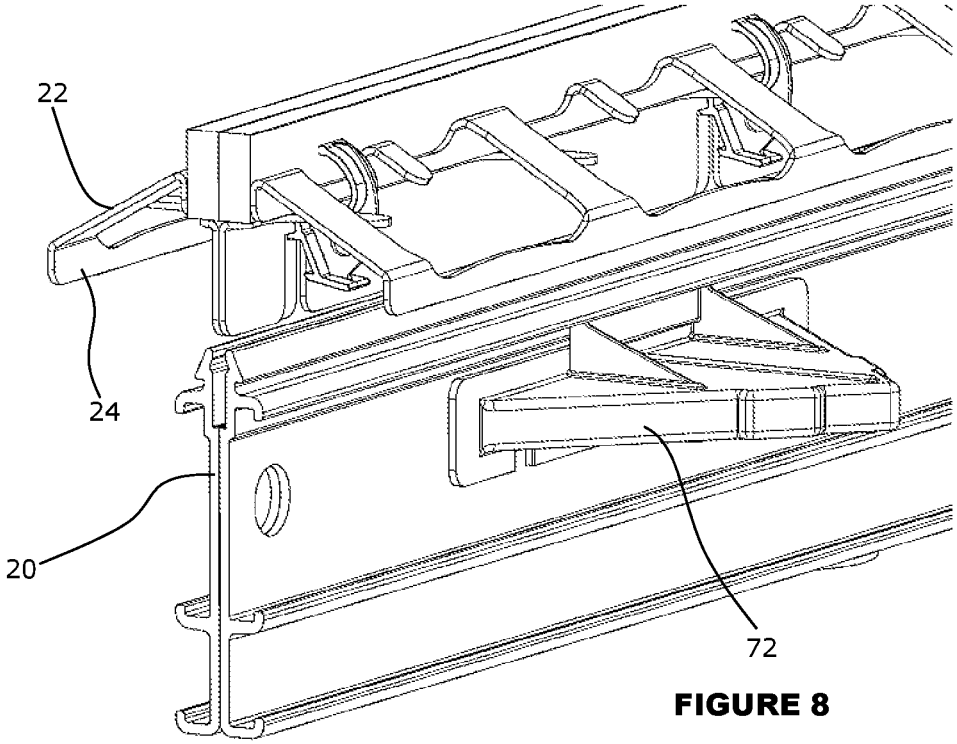
FIG. 8 shows an end perspective view of the module fitted with the dowel sheath.
Figure 9:
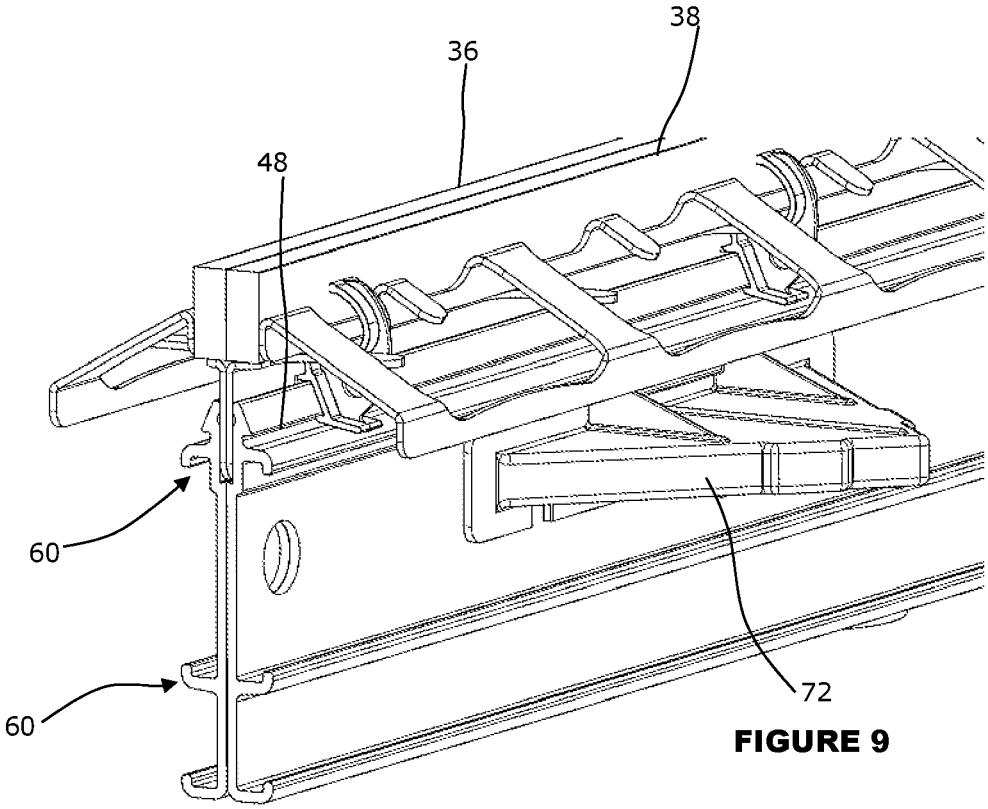
FIG. 9 is a further end perspective view of the module showing detail of the dowel sheath.

With reference to FIG. 5, click in joiner plates 96 are provided for joining together adjacent formwork lengths 20, by virtue of the joiner plates 96 sliding into vertically opposed rails 60 of the formwork lengths 20. Each of the joiner plates 96 has an integrally formed laterally offset tongue 98 which is able to be elastically deformed laterally so as to engage with circular holes formed in the formwork lengths 20 to prevent the formwork lengths 20 from unwantedly coming apart. Each of the joiner plates 96 also has a pair of protrusions which may be in the form of nipples 100 for limiting insertion of the joiner plates 96 into the formwork lengths 20. The nipples 100 may also serve to provide spacing between the formwork lengths 20 so as to allow for contraction of the edge protection system 10 as the concrete panels contract during drying.

Retaining Clip

With reference to FIGS. 1 to 12 of the drawings, the edge protection system 10 include a retaining clip 28 for retaining the second part 14 to the first part 12, the retaining clip 28 being frangible to allow separation of the first and second parts 12 and 14 after setting of the first and second concrete flooring panels.

Figure 12:
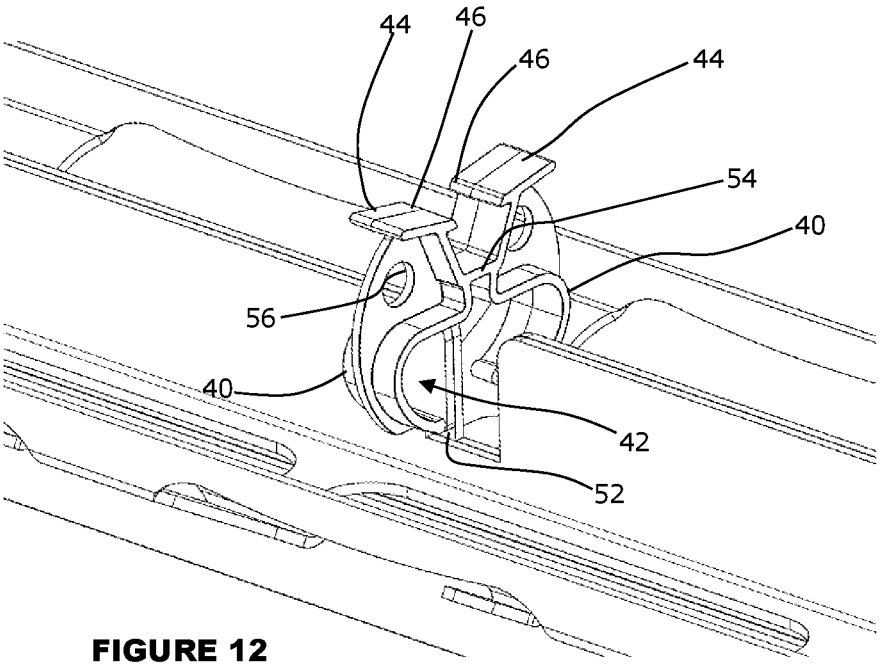
FIG. 12 shows an inverted view of the retainment arrangement in an unlocked configuration with the retaining clip being removed therefrom.

The retaining clip 28 engages with a first rail 36 extending along the length of the first part 12 and a second rail 38 extending along the length of the second part 14. As can be seen in FIG. 12, the retaining clip 28 has a pair of opposed arcuate arms 40 which serve to hold together the first rail 36 and second rail 38. The arcuate arms 40 extend outwardly in an arcuate manner such that when in place retaining the second part 14 to the first part 12, the retaining clip 28 forms an aperture 42 on each side of the edge protection system 10 for accommodating the bridging pins 18. As discussed earlier, the edge protection system 10 is provided in modular lengths 16 and adjacent modular lengths 16 are coupled together by one or more bridging pins 18.

Figure 10:
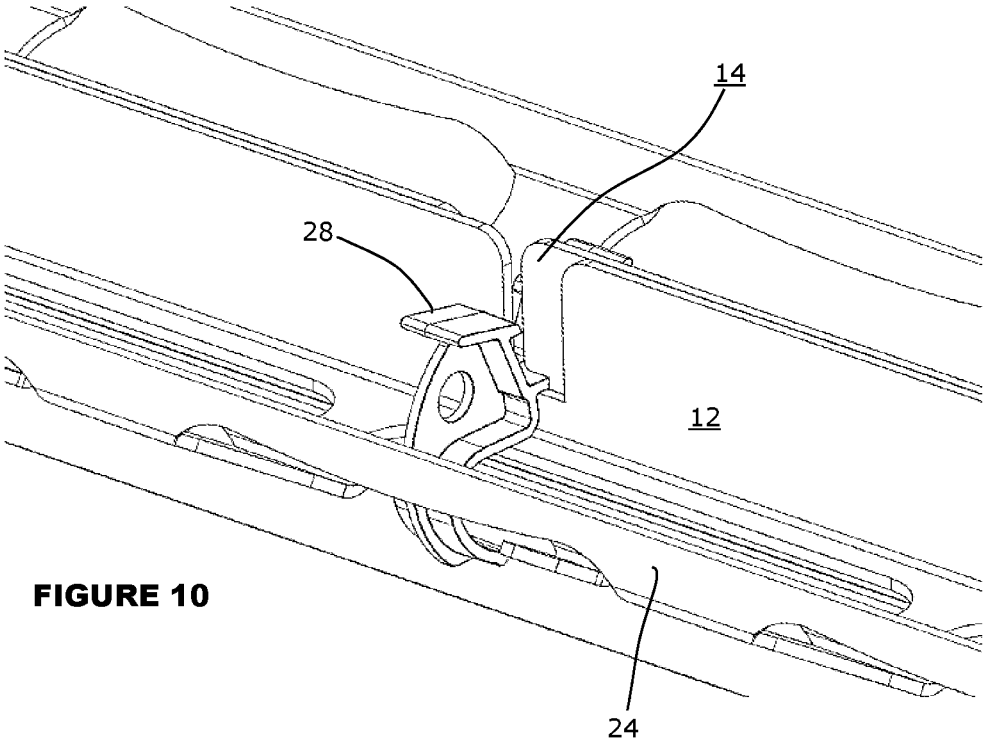
FIG. 10 shows an inverted view of an anchorage length of the module, with a retainment arrangement thereof in a locked configuration so as to lock a retaining clip thereto.
Figure 11:
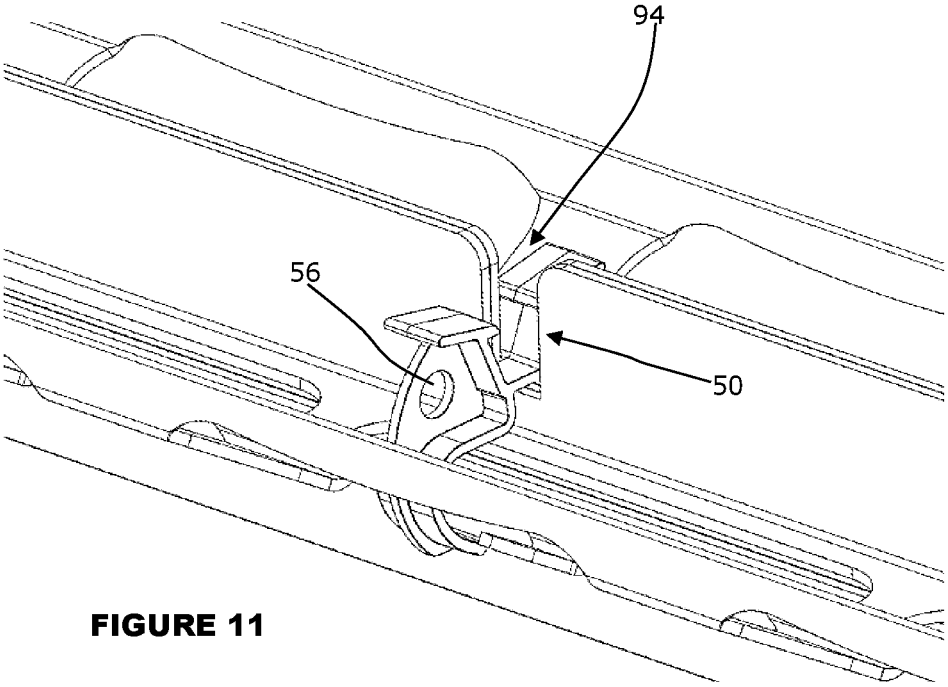
FIG. 11 shows an inverted view of the anchorage length with the retainment arrangement in an unlocked configuration and the retaining clip resting in a slot thereof.

With reference to FIGS. 10 to 12, a lower end of the retaining clip 28 includes a pair of opposed feet 44 having opposed heels which engage beneath a ridge 48 on each side of the edge protection system 10 so as to hold the retaining clip 28 to the formwork lengths 20. Also, with reference to FIGS. 10 to 12, the retaining clip 28 is held to the anchorage lengths 22 by virtue of a slot 50 which is formed by an L-shaped formation 52 in each of the opposed sides of the anchorage length 22, with the L-shaped formations of the two sides having the foot of the L extending in mutually opposite directions such that the two sides can be slid to open the slot 50 as shown in FIGS. 11 and 12 for insertion of the retaining clip 28, and, with the retaining clip cross-arm 54 resting at the base of the slot 50, the two sides are able to be slid into the locked configuration shown in FIG. 10 so as to retain the clip 28 against removal from the slot 50.

The retaining clip 28 cross-arm 54 is frangible so as to allow the first part 12 and the second part 14 to separate once the neighbouring concrete panels have been formed. The retaining clip 28 is also provided with a pair of anchorage apertures 56, one on each arcuate arm thereof, to anchor the arms within the respective concrete panels such that the panels pull apart the retaining clip 28 to break same during contraction of the panels.

Support Foot

With reference to FIGS. 13 to 18, it is shown that the edge protection system 10 may include a support foot 58 for supporting the system 10 relative to a ground surface. The first part 12 has a pair of vertically opposed longitudinal rails 60, and the support foot has an engagement formation 62 which has an unlocked orientation (see FIG. 13) for inserting the formation 62 between the opposed rails 60 to abut against the first part 12 and a rotated, locked orientation (see FIG. 14) wherein the formation 62 is locked by the rails 60 against lateral withdrawal from the first part 12. The engagement formation 62 may be in the form of a generally rectangular support plate having diagonally opposed truncated corners to facilitate insertion then rotation between the longitudinal rails 60. The engagement formation 62 having the truncated corners may be generally in the form of a trapezoid.

The edge protection system 10 may include a second support foot 58 for supporting the system 10 relative to the ground surface on an opposite side of the edge protection system from the first support foot 58 and the support feet 58 on opposite sides of the edge protection system 10 may be provided at regular intervals along the length of the edge protection system 10 so as to adequately support same above the ground surface. More specifically, in a similar manner, the second part 14 may have a pair of vertically opposed longitudinal rails 60, and the second support foot 58 may have an engagement formation 62 which has an unlocked orientation for inserting the formation 62 between the opposed rails 60 to abut against the second part 14 and a rotated, locked orientation wherein the formation 62 is locked by the rails 60 against lateral withdrawal from the part 14. The formation 62 may be unlocked from the opposed rails 60 by rotation of the formation 62 about a lateral axis of the system 10 from the locked orientation to the unlocked orientation. More specifically, the lateral axis is perpendicular to the support plate of the support foot 58. Advantageously, by virtue of the opposed longitudinal rails 60 and the engagement formation 62, the support foot 58 is able to be installed at an infinitely variable number of locations along the length of the edge protection system.

Figure 13:
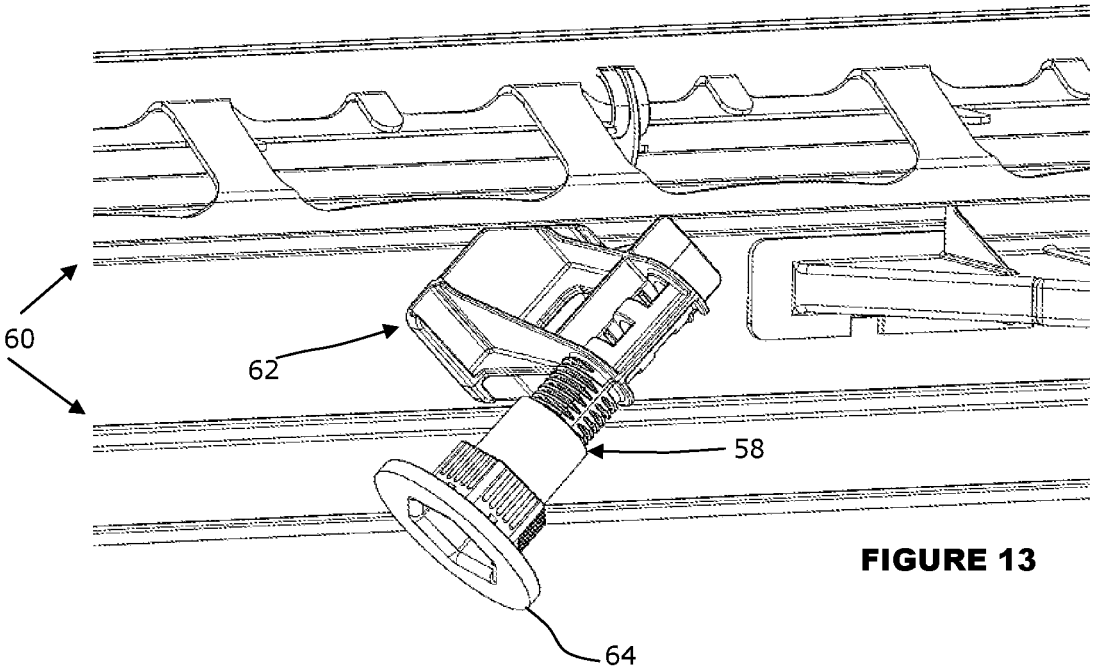
FIG. 13 shows a support foot in an unlocked orientation relative to the module.
Figure 14:
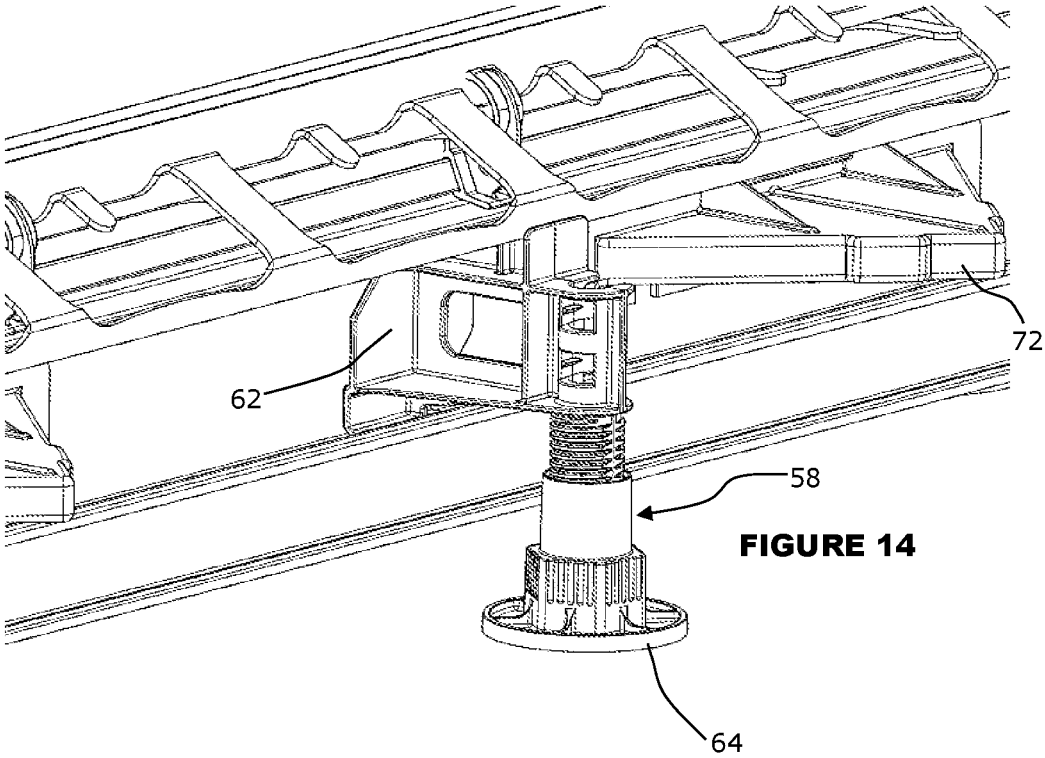
FIG. 14 shows the foot in a locked orientation relative to the module.
Figure 15:
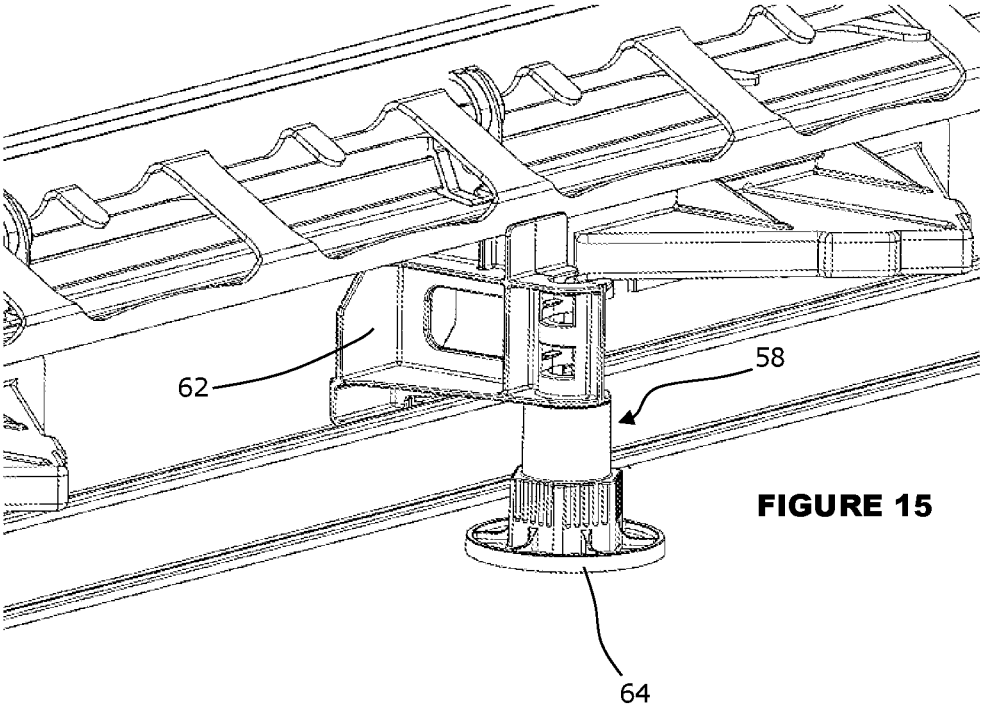
FIG. 15 shows the support foot engaged to the module, with the support foot contracted by screw mechanism.
Figure 16:
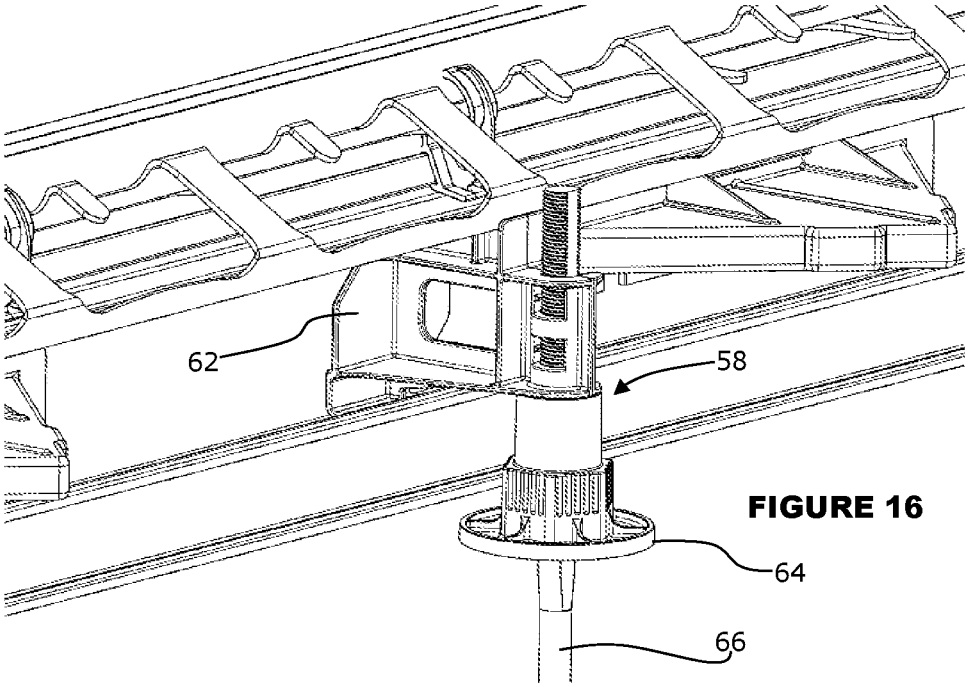
FIG. 16 shows the support foot engaged to the module with a threaded stake inserted into the support foot.
Figure 17:
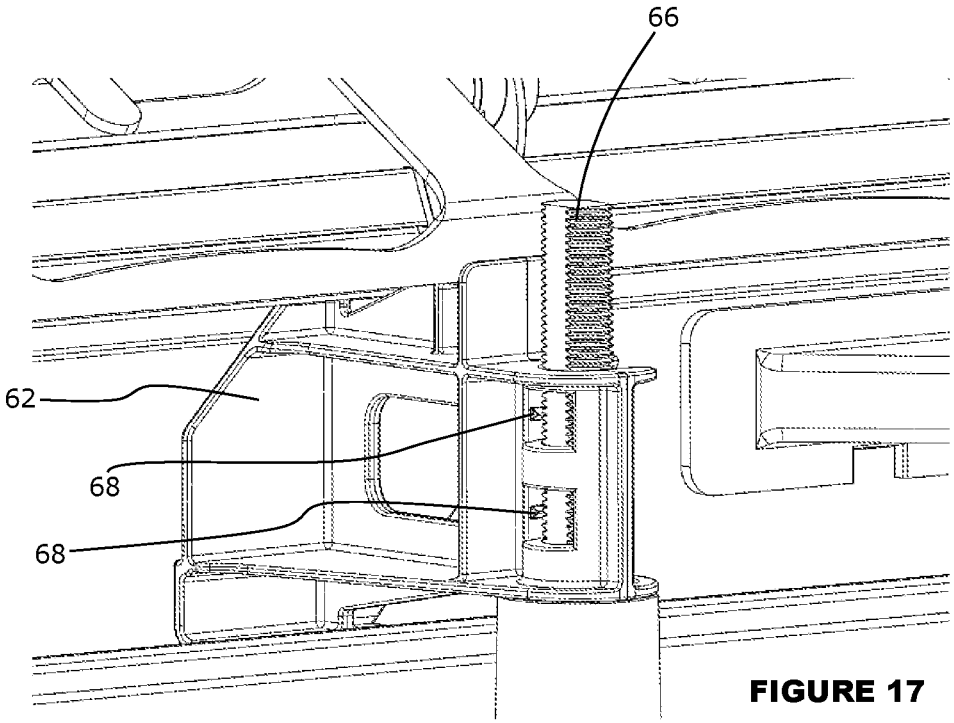
FIG. 17 shows detail of the support foot with the stake rotated 90 degrees so as to vertically engage with the support foot.
Figure 18:
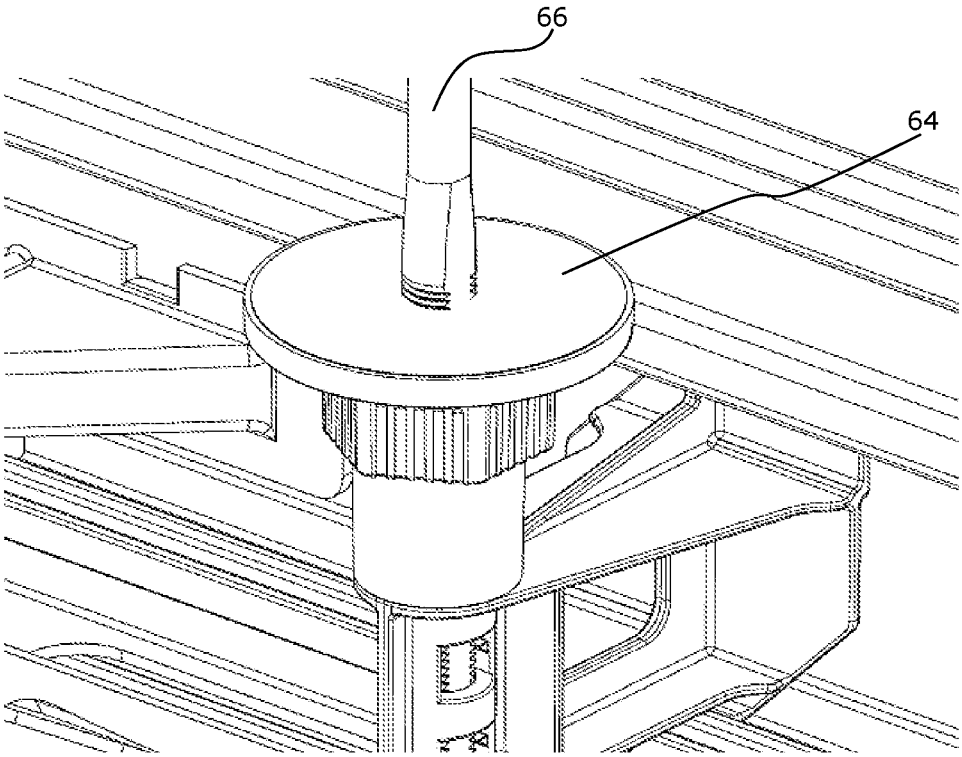
FIG. 18 shows underside detail of the threaded stake entering the support foot.
Figure 19:
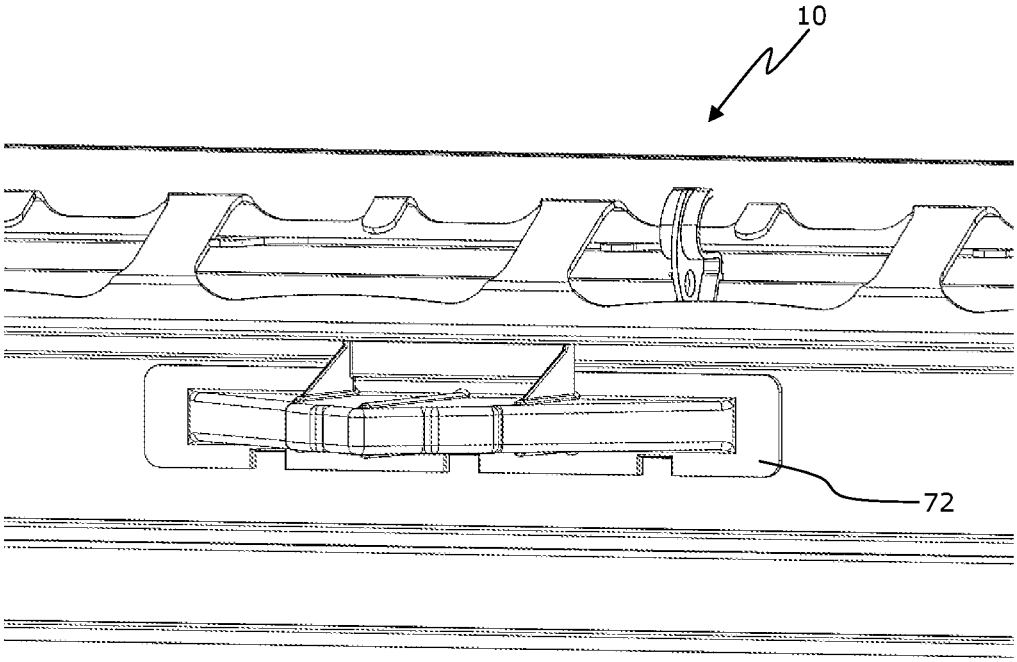
FIG. 19 shows one side of the module fitted with the dowel sheath.
Figure 20:
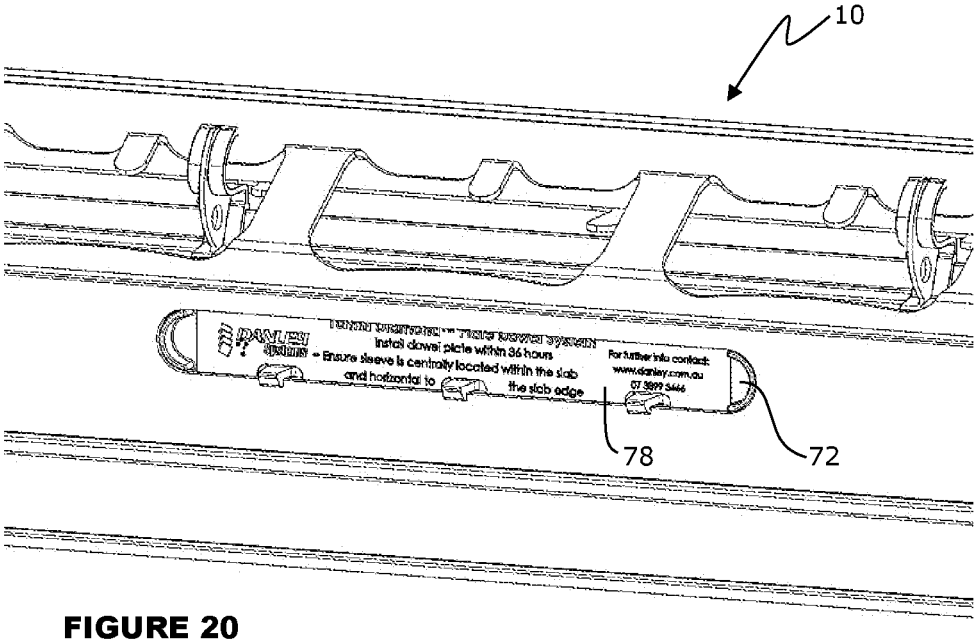
FIG. 20 shows an opposite side of the module fitted with the dowel sheath.

As shown in FIGS. 13 and 14, the support foot 58 may be provided in two parts, being the engagement formation 62 and a footing 64, with the footing 64 being threadedly coupled to the engagement formation 62 such that the height of the footing 64 is able to be adjusted relative to the engagement formation 62. This threaded engagement is shown in an extended condition in FIGS. 13 and 14, and in a contracted condition in FIGS. 15 and 16. A stake 66 may be used in conjunction with the support foot 58 in the manner depicted in FIGS. 16 to 18. In particular, the stake may have a threaded upper end which is stripped of the thread by providing opposed flat planar faces separating parts of the thread. In this way, the threaded stake is able to be inserted upwardly through a central aperture of the support foot 58 in the orientation shown in FIG. 16, then may be locked relative to the support foot 58 by rotating the stake 66 through a rotation of 90 degrees along the axis of the stake 66 such that the threaded part of the stake 66 engages against locking ribs 68 provided on the support foot 58. The flattened opposed faces of the stake 66 may also enable the stake 66 to be efficiently manipulated by way of a spanner or adjustable wrench.

Dowel Plate

With reference to FIGS. 19 to 23, the edge protection system 10 may be provided with a dowel plate 70 and a dowel sheath 72, wherein the dowel plate 70 is for supporting the second concrete flooring panel relative to the first concrete flooring panel. The dowel sheath 72 is fitted to extend laterally from the first part 12, with an internal cavity of the dowel sheath 72 aligning with apertures 74 formed in the first and second parts 12 and 14 such that the dowel plate 70 is able to be inserted into the dowel sheath cavity 76 through said apertures 74 to a supporting position in which the dowel plate 70 remains in the apertures 74 and extends laterally from the second part 14. In this way, the dowel plate 70 extends laterally on either side of the formwork length 20, with one of these sides being housed by the dowel sheath 72. The dowel plate 70 is able to slide within the dowel sheath 72 so as to accommodate horizontal movement of one concrete panel away from the other concrete panel. Advantageously, the dowel plate 70 is able to provide vertical support of one concrete panel relative to the other concrete panel. Also, as depicted, the dowel plate 70 and dowel sheath 72 are generally rectangular (or square) and are oriented such that sides of the dowel plate 70 and dowel sheath 72 extend at an angle of approximately 45 degrees relative to the first and second parts 12 and 14. This configuration is advantageous as the applicant has determined that shrinkage of concrete as it dries is typically consistent with this 45 degree orientation.

Figure 21:
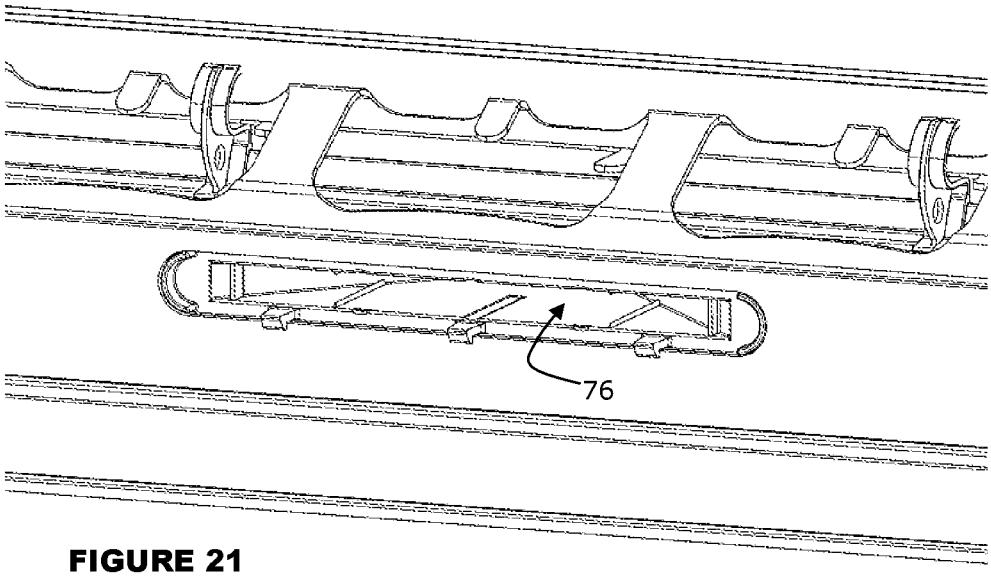
FIG. 21 shows an internal cavity of the dowel sheath with a membrane seal removed.
Figure 22:
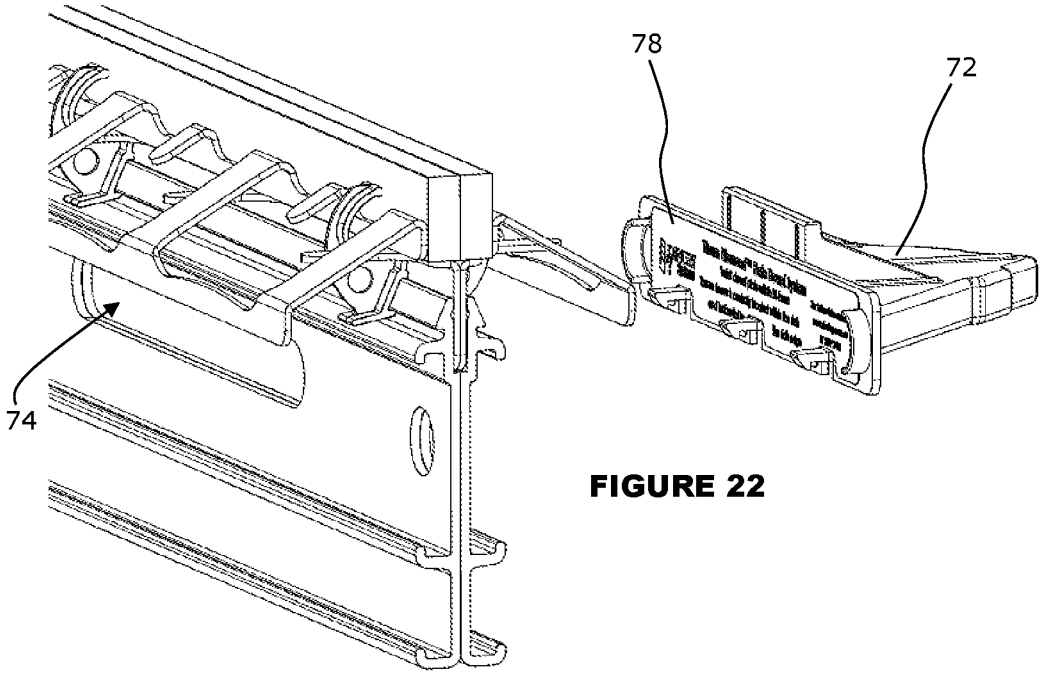
FIG. 22 shows the dowel sheath prior to being fitted to the module.
Figure 23:
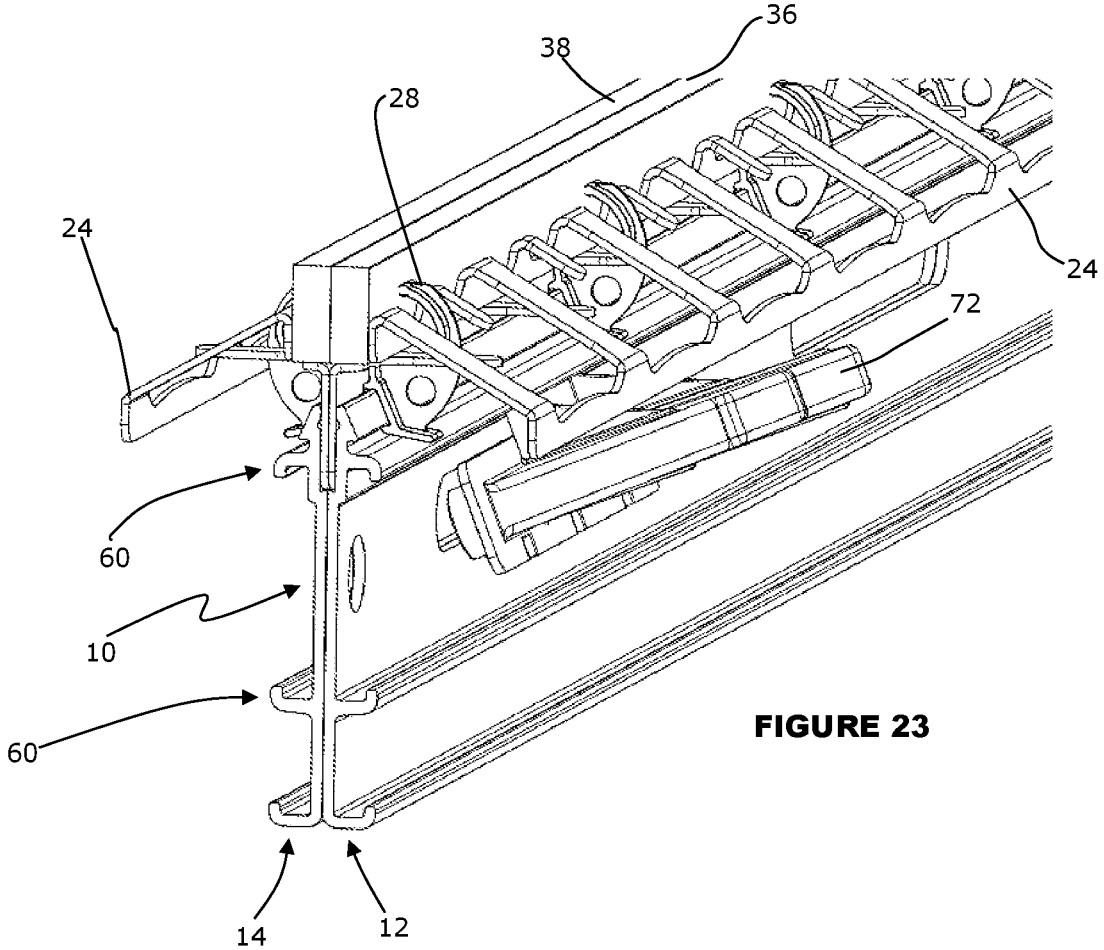
FIG. 23 shows the dowel sheath in a process of being fitted to the module.
Figure 24:
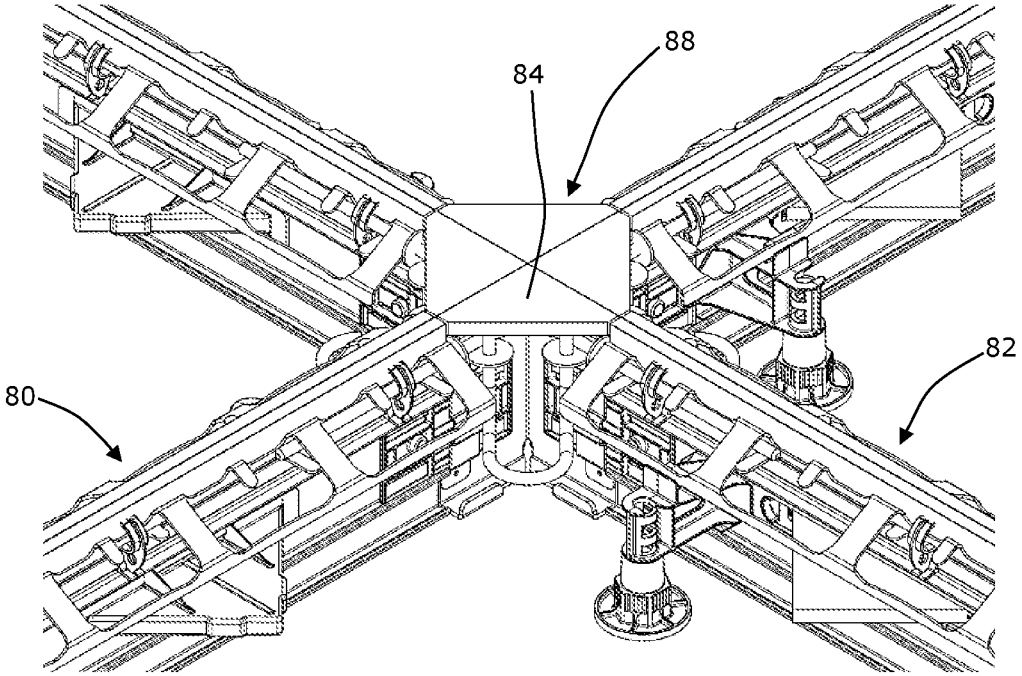
FIG. 24 shows a top perspective view of a modular intersection part at the centre of a four-way intersection of perpendicular modules.

The apertures 74 formed in the first and second parts 12 and 14 may be in the form of slots to minimise the size of the apertures 74 required to insert and house the dowel plate 70. The dowel sheath 72 may be provided with a seal over the cavity 76 to minimise ingress of concrete into the cavity 76. The seal 78 can be removed from the dowel sheath 72 once the concrete panel surrounding the dowel sheath 72 has been poured, and the dowel plate 70 may be inserted at that time prior to the pouring of the concrete panel on the opposite side of the edge protection system 10. The seal may be frangible such that the dowel plate 70 is able to slice its own way through the seal 78 so as to be inserted into the cavity 76. As shown in FIGS. 21 and 22, the dowel sheath 72 may be provided with abutments at either end to prevent longitudinal sliding of the dowel sheath 72 relative to the slots formed in the first and second parts 12, 14, and may also be provided with elastically deformable hooks along a lower edge thereof so as to couple with a lower edge of the slot (see FIG. 21). FIG. 23 shows the manner of attachment of the dowel sheath 72 to the formwork length 20 by angling the dowel sheath 72 downwardly into the slot to locate the upper edge of the slot on an upper edge of the dowel sheath 72 prior to rotating the distal end of the dowel sheath 72 downwardly to effect clipping of the elastically deformable hooks on the lower edge of the slot.

Corner System

With reference to FIGS. 24 to 27 of the drawings, there is shown an edge protection system 10 for use with concrete flooring, including an initial edge unit 80 having a first part 12 and a second part 14, the first part 12 for coupling to an edge portion of a first concrete flooring panel and the second part 14 for coupling to an opposed edge portion of a second, neighbouring, concrete flooring panel. The system 10 also includes an angled edge unit 82 having a first part and a second part 14, the first part for coupling to another edge portion of the second concrete flooring panel and the second part for coupling to an opposed edge portion of a third, neighbouring, concrete flooring panel. The edge protection system 10 further includes a modular intersection part 84 at an intersection of the first to third panels. The modular intersection part 84 is adapted to be coupled to the initial edge unit 80 with the initial edge unit 80 extending radially from the modular intersection part 84 in a first direction. The modular intersection part 84 is adapted to be coupled to the angled edge unit 82 with the angled edge unit 82 extending radially from the modular intersection part 84 in a second direction at an angle to the first direction.

With reference to the particular example shown in FIGS. 24 to 27 of the drawings, the second direction may be perpendicular to the first direction. In alternative examples, it is possible that the angle may be other than 90 degrees. The modular intersection part 84 may include a horizontal upper face portion 86 which extends over at least a corner portion 88 of each of the first, second and third panels.

Figure 25:
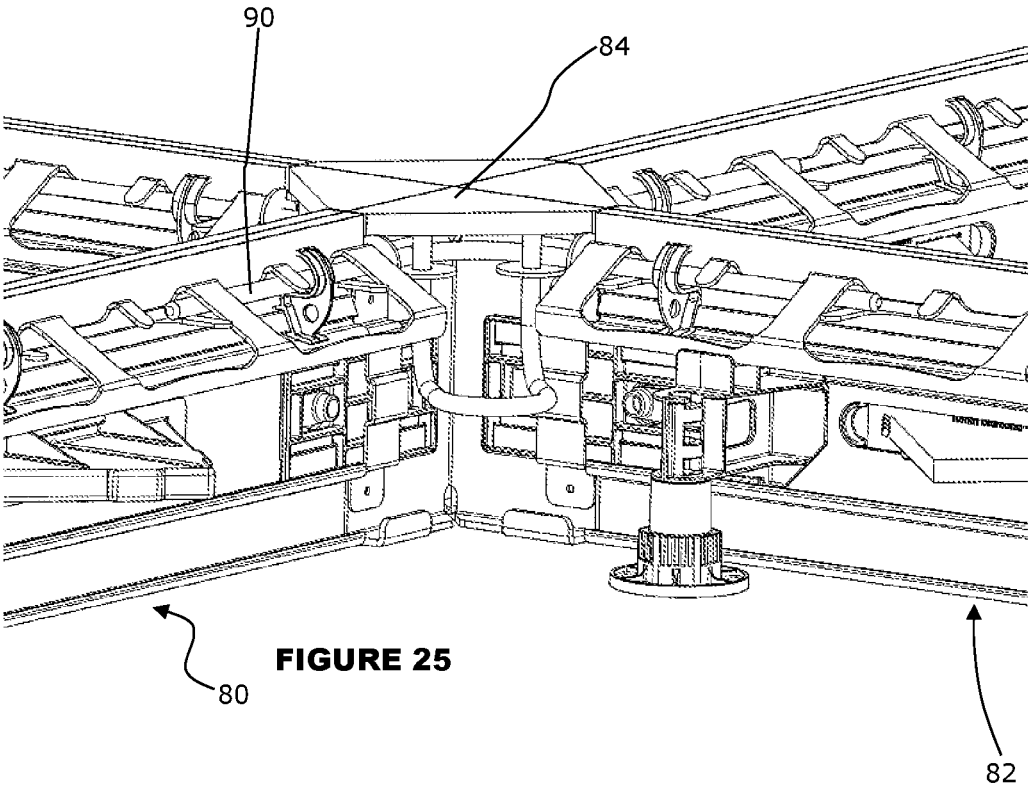
FIG. 25 shows a side perspective view of the modular intersection part.
Figure 26:
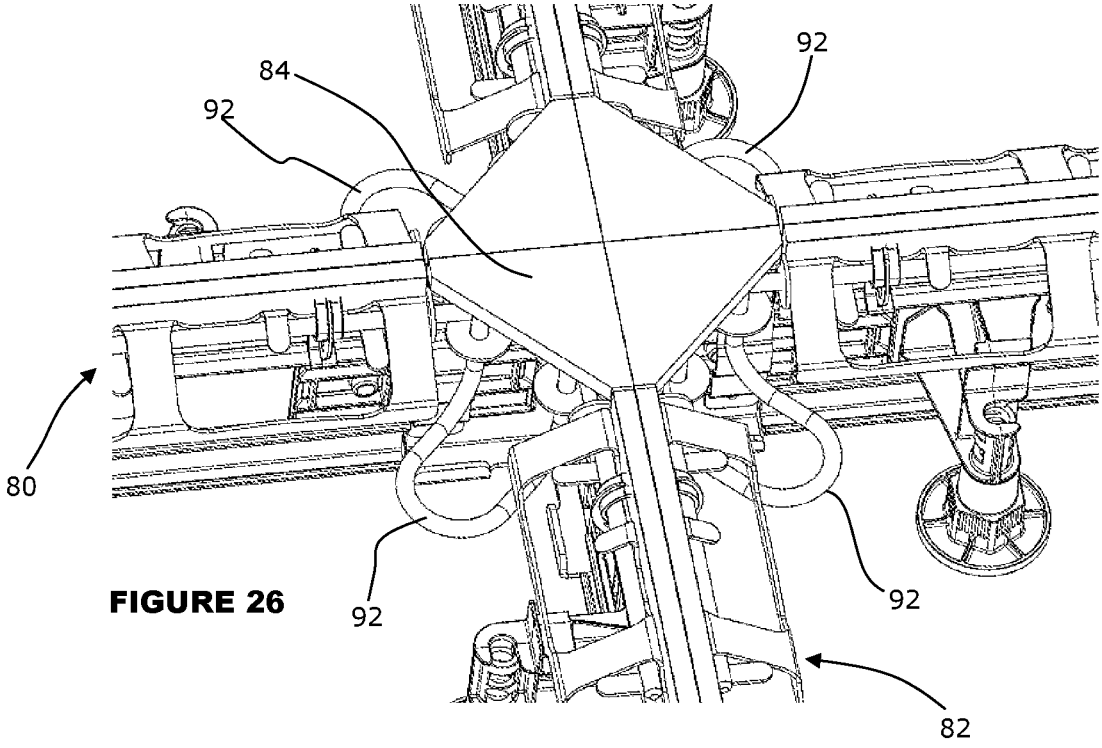
FIG. 26 shows a detailed top perspective view of the modular intersection part.
Figure 27:
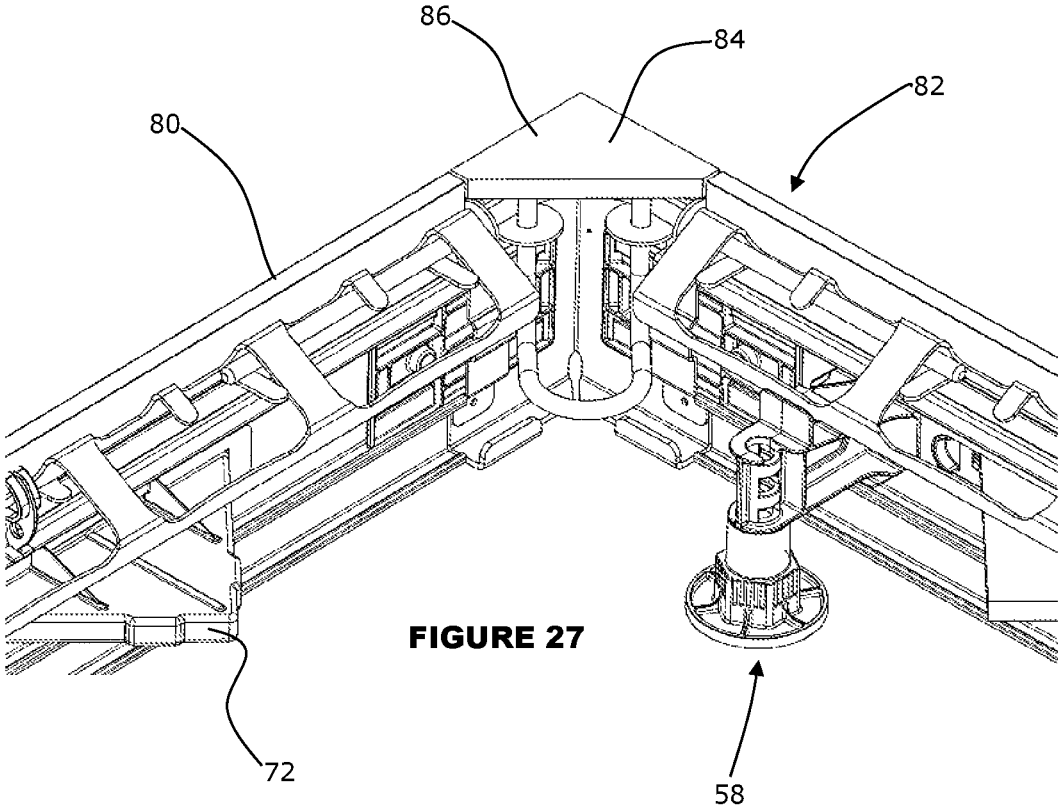
FIG. 27 shows a modular intersection part between a pair of perpendicular modules.

With reference to FIG. 25, a bridging pin 90 formed with a 90 degree bend may be used to couple together the perpendicular edge protection systems as well as the modular intersection part 84. Furthermore, a loop lock 92 may be provided to depend from the horizontal upper face portion and to extend in a generally 45 degree angle into the concrete panel, for each concrete panel formed into the modular intersection part 84. Advantageously, the loop lock 92 assists in providing a centre restraint so as to restrain the concrete panel to the modular intersection part 84. Also, the horizontal upper face portion 86 has a crack forming edge formed across each of the concrete panels so as to force cracking at the corners rather than to allow cracks to occur at undesirable locations.

Clip Retainment

With reference to FIGS. 10 to 12 of the drawings, there is shown an edge protection system 10 for use with concrete flooring, including a first part 12 for coupling to an edge portion of a first concrete flooring panel and a second part for coupling to an opposed edge portion of a second neighbouring, concrete flooring panel, wherein the system 10 includes a retaining clip 28 for retaining the second part 14 to the first part 12, and the first part 12 is slidable relative to the second part 14 to engage the retaining clip 18 against removal from the first and second parts 12 and 14.

More specifically, the first part 12 includes an L-shaped cut-out having a vertical slot and a horizontal slot, and the second part 14 includes an L-shaped cut-out having a vertical slot and a horizontal slot. The cut-outs are configured such that longitudinal sliding of the first part 12 relative to the second part 14 enables a relatively wide opening for insertion of the retaining clip 28 when the vertical slots are aligned, and a closure to prevent removal of the retaining clip 28 when the cut-outs are slid away from alignment. This may be achieved by way of the L-shaped cut-outs (that is, the L-shaped cut-out in the first part 12 and the L-shaped cut-out in the second part 14) forming the same shape when viewed from opposite sides of the edge protection system 10. FIG. 12 shows the first and second parts 12 and 14 arranged with the vertical slots in alignment to provide the relatively wide opening 94, FIG. 11 shows the vertical slots in the same alignment to form the opening 94 with the retaining clip inserted into the opening 94, and FIG. 10 shows the cut-outs slid away from alignment so as to engage the retaining clip 28 against removal from the first and second parts 12 and 14. The passage defined by the cut-outs in the open configuration may be in the form of an elongated slot as shown in FIGS. 11 and 12, whereas the passage defined by the cut-outs when in the misaligned condition may be in the form of an inverted T-shaped passage as shown in FIG. 10.

While various embodiments of the present invention have been described above, it should be understood that they have been presented by way of example only, and not by way of limitation. It will be apparent to a person skilled in the relevant art that various changes in form and detail can be made therein without departing from the spirit and scope of the invention. Thus, the present invention should not be limited by any of the above described exemplary embodiments.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The invention claimed is:

1. An edge protection system for use with concrete flooring, the edge protection system comprising:

a first part couplable to an edge portion of a first concrete flooring panel, the first part including a first pair of opposed longitudinal rails;

a second part couplable to an opposed edge portion of an adjacent second concrete flooring panel; and a first support foot including a first engagement formation configured to be in an unlocked orientation that enables insertion of the first engagement formation between the first pair of opposed rails, and configured to be in a rotated locked orientation such that the first engagement formation is locked by the first pair of opposed rails against lateral withdrawal from the first part, the first engagement formation including a locking rib, a stake having threads and opposing unthreaded surfaces separating parts of the threads, the stake being insertable into the first engagement formation and being rotatable in the first engagement formation to cause the threads of the stake to engage the locking rib to lock the stake in the first engagement formation, and a first footing threadedly couplable to the stake such that the stake enables adjustment of a height of the first footing relative to the first engagement formation.

2. The edge protection system of claim 1, wherein the second part includes a second pair of opposed longitudinal rails, and which includes a second support foot including a second engagement formation configured to be in an unlocked orientation that enables insertion of the second engagement formation between the second pair of opposed rails, and configured to be in a rotated locked orientation such that the second engagement formation is locked by the second pair of opposed rails against lateral withdrawal from the second part.

3. The edge protection system of claim 2, wherein the first engagement formation is unlockable from the first pair of opposed rails by rotation of the first engagement formation about a first lateral axis from the locked orientation to the unlocked orientation.

4. The edge protection system of claim 3, wherein the second engagement formation is unlockable from the second pair of opposed rails by rotation of the second engagement formation about a second lateral axis from the locked orientation to the unlocked orientation.

5. The edge protection system of claim 1, wherein the first engagement formation is-includes a support plate having diagonally opposed truncated corners.

6. The edge protection system of claim 5, wherein the first engagement formation includes a trapezoid support plate.

7. The edge protection system of claim 1, wherein the first engagement formation includes a trapezoid support plate.

8. The edge protection system of claim 1, wherein the first footing is threadably attachable to the stake.

9. An edge protection system support foot for an edge protection system for use with concrete flooring, the edge protection system support foot comprising:

an engagement formation configured to be in an unlocked orientation that enables insertion of the engagement formation between a first pair of opposed rails of a first part of the edge protection system, wherein the first part is couplable to an edge portion of a first concrete flooring panel, and configured to be in a rotated locked orientation such that the engagement formation is locked by the opposed rails against lateral withdrawal from the first part, wherein the engagement formation includes a support plate having diagonally opposed truncated corners, the engagement formation including a locking rib;

a stake having threads and opposing unthreaded surfaces separating parts of the threads, the stake being insertable into the engagement formation and being rotatable in the engagement formation to cause the threads of the stake to engage the locking rib to lock the stake in the engagement formation; and a footing attachable to the stake.

10. The edge protection system support foot of claim 9, wherein the engagement formation is unlockable from the first pair of opposed rails by rotation of the engagement formation about a lateral axis from the locked orientation to the unlocked orientation.

11. The edge protection system of claim 9, wherein the first footing is threadedly couplable to stake.

12. An edge protection system for use with concrete flooring, the edge protection system comprising:

a first part couplable to an edge portion of a first concrete flooring panel, the first part including a first pair of opposed longitudinal rails;

a second part couplable to an opposed edge portion of an adjacent second concrete flooring panel; and a first support foot including a first engagement formation configured to be in an unlocked orientation that enables insertion of the first engagement formation between the first pair of opposed rails, and configured to be in a rotated locked orientation such that the first engagement formation is locked by the first pair of opposed rails against lateral withdrawal from the first part, wherein the first engagement formation includes a support plate having diagonally opposed truncated corners, the first engagement formation including a locking rib, and a stake having threads and opposing unthreaded surfaces separating parts of the threads, the stake being insertable into the first engagement formation and being rotatable in the first engagement formation to cause the threads of the stake to engage the locking rib to lock the stake in the first engagement formation.

13. An edge protection system support foot for an edge protection system for use with concrete flooring, the edge protection system support foot comprising:

an engagement formation configured to be in an unlocked orientation that enables insertion of the engagement formation between a first pair of opposed rails of a first part of the edge protection system, wherein the first part is couplable to an edge portion of a first concrete flooring panel, and configured to be in a rotated locked orientation such that the engagement formation is locked by the opposed rails against lateral withdrawal from the first part, wherein the engagement formation includes a trapezoid support plate, the engagement formation including a locking rib;

a stake having threads and opposing unthreaded surfaces separating parts of the threads, the stake being insertable into the engagement formation and being rotatable in the engagement formation to cause the threads of the stake to engage the locking rib to lock the stake in the engagement formation; and a footing attachable to the stake.

* * * * *